US008457515B2

(12) United States Patent
Barton

(10) Patent No.: US 8,457,515 B2
(45) Date of Patent: Jun. 4, 2013

(54) APPARATUS AND METHOD FOR CONTROLLING PRESSURE ROLL FLARE IN A PRINT APPARATUS

(75) Inventor: Augusto E. Barton, Webster, NY (US)

(73) Assignee: Xerox Corporation, Norwalk ( * ) Notice: Subject to any disclaimer, the term of this patent is extended or adjusted under 35 U.S.C. 154(b) by 224 days.

(21) Appl. No.: 12/971,681

(22) Filed: Dec. 17, 2010

(65) Prior Publication Data

US 2012/0155906 A1 Jun. 21, 2012

(51) Int. Cl.
*G03G 15/20* (2006.01)

(52) U.S. Cl.
USPC ..... 399/69; 399/331

(58) Field of Classification Search
USPC ..... 399/67, 68, 122, 320–332, 338; 219/216, 219/219, 469, 619; 72/199–252; 347/10, 347/23, 43
See application file for complete search history.

(56) References Cited

U.S. PATENT DOCUMENTS 5,550,621 A * 8/1996 Ogawahara ..... 399/69
7,054,572 B2 * 5/2006 Baruch et al. ..... 399/69
2004/0190925 A1 * 9/2004 Baruch et al. ..... 399/69
2008/0152401 A1 * 6/2008 Kimura ..... 399/328
2009/0116885 A1 * 5/2009 Ando ..... 399/329

* cited by examiner

*Primary Examiner* — Clayton E LaBalle
*Assistant Examiner* — Victor Verbitsky
(74) *Attorney, Agent, or Firm* — Ronald E. Prass, Jr.; Prass LLP

(57) ABSTRACT

An apparatus and method that control pressure roll flare in a print apparatus. The apparatus can include a fuser having a fuser surface. The apparatus can include at least one heat source configured to heat the fuser surface. The apparatus can include a pressure roll having a pressure roll surface, the pressure roll having a rotational axis, the pressure roll having an inside paper path portion towards the middle of the pressure roll along the rotational axis and having an outside paper path portion near at least one end of the pressure roll along the rotational axis, the pressure roll coupled to the fuser at a fuser nip, where the fuser nip is configured to fuse marking material on a media sheet. The apparatus can include a pressure roll cooling device configured to cool at least one of the inside paper path portion and the outside paper path portion of the pressure roll to maintain substantially consistent pressure roll flare prior to media sheets entering the fuser nip and while media sheets pass through the fuser nip to provide wrinkle control of media sheets while limiting image smear of the marking material on the media sheets.

20 Claims, 8 Drawing Sheets

600

700

APPARATUS AND METHOD FOR CONTROLLING PRESSURE ROLL FLARE IN A PRINT APPARATUS

BACKGROUND

Disclosed herein is an apparatus and method that controls pressure roll flare in a print apparatus.

Presently, image output devices, such as printers, multifunction media devices, xerographic machines, ink jet printers, and other devices produce images on media sheets, such as paper, substrates, transparencies, plastic, labels, or other media sheets. To produce an image, marking material, such as toner, ink jet ink, or other marking material, is applied to a media sheet to create a latent image on the media sheet. A fuser assembly then affixes or fuses the latent image to the media sheet by applying heat and/or pressure to the media sheet.

Fuser assemblies apply heat and pressure using rotational members, such as fuser rolls or belts, that are coupled to each other at a fuser nip. The rotational members apply heat and pressure to the media sheet with the latent image as the media sheet is fed through the fuser nip to affix the image to the media sheet.

Some fuser rolls are flared to reduce wrinkling of media sheets in the fuser nip. In particular, the fuser roll or pressure roll is flared by having a wider diameter at its outside paper path portion than the diameter at its inside paper path portion. This flare provides a tentering force on media sheets to reduce wrinkle of the media sheets as they pass through the fuser nip. It is useful to have a fuser roll with a predictable flare.

Unfortunately, the fuser or pressure roll flare changes between standby operation and steady state print job operation. This change is caused by a thermal differential between the fuser roll inside paper path and the fuser roll outside paper path, which is caused by media sheets cooling the pressure roll inside paper path during a print job. For example, the pressure roll has a room temperature flare. The diameter of the pressure roll inside paper path reduces as media sheets cool the inside paper path of the pressure roll while the outside paper path diameter grows as the fusing belt cools the outside paper path of the pressure roll during a print job, which increases the pressure roll flare. Thus, the pressure roll may have insufficient flare to reduce wrinkling of the first media sheets at the beginning of a print job before the fuser temperatures settle to steady state operation. Furthermore, the pressure roll may also achieve excessive flare during the print job when the media sheets cool the inside paper path. This excessive flare produces an undesirable result of smeared images on the media sheets.

Thus, there is a need for an apparatus and method that controls pressure roll flare in a print apparatus.

SUMMARY

An apparatus and method that controls pressure roll flare in a print apparatus is disclosed. The apparatus can include a fuser having a fuser surface. The apparatus can include at least one heat source configured to heat the fuser surface. The apparatus can include a pressure roll having a pressure roll surface. The pressure roll can have a rotational axis. The pressure roll can have an inside paper path portion towards the middle of the pressure roll along the rotational axis and can have an outside paper path portion near at least one end of the pressure roll along the rotational axis. The pressure roll can be coupled to the fuser at a fuser nip, where the fuser nip can be configured to fuse marking material on a media sheet. The apparatus can include a pressure roll cooling device configured to cool at least one of the inside paper path portion and the outside paper path portion of the pressure roll to maintain substantially consistent pressure roll flare prior to media sheets entering the fuser nip and to maintain the substantially consistent pressure roll flare while media sheets pass through the fuser nip to provide wrinkle control of media sheets while limiting image smear of the marking material on the media sheets.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and do not limit its scope, the disclosure will be described and explained with additional specificity and detail through the use of the drawings in which.

DETAILED DESCRIPTION

Figure 1:
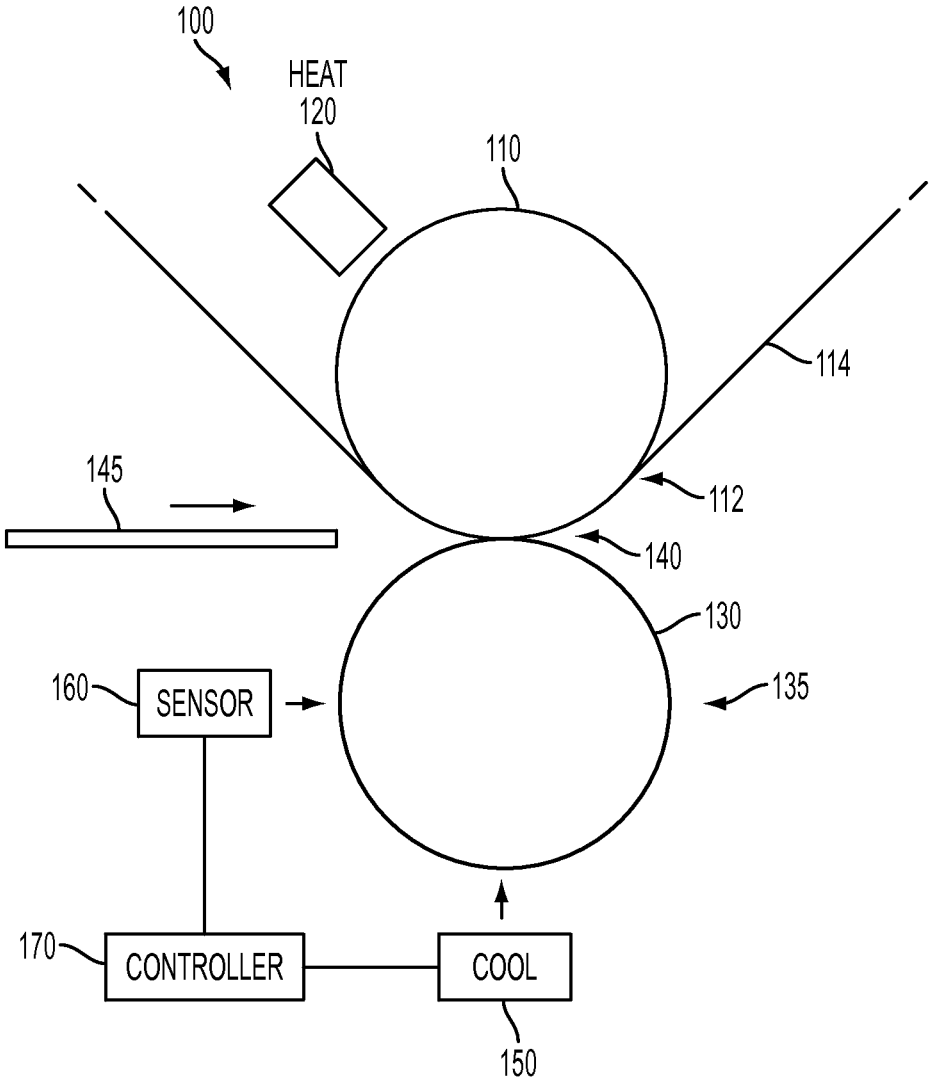
FIG. 1 is an example illustration of an apparatus.

The embodiments include an apparatus that controls pressure roll flare in a print apparatus. The apparatus can include a fuser having a fuser surface. The apparatus can include at least one heat source configured to heat the fuser surface. The apparatus can include a pressure roll having a pressure roll surface, the pressure roll having a rotational axis, the pressure roll having an inside paper path portion towards the middle of the pressure roll along the rotational axis and having an outside paper path portion near at least one end of the pressure roll along the rotational axis, the pressure roll coupled to the fuser at a fuser nip, where the fuser nip is configured to fuse marking material on a media sheet. The apparatus can include a pressure roll cooling device configured to cool at least one of the inside paper path portions and the outside paper path portions of the pressure roll to maintain substantially consistent pressure roll flare prior to media sheets entering the fuser nip and while media sheets pass through the fuser nip to provide wrinkle control of media sheets while limiting image smear of the marking material on the media sheets.

The embodiments further include a method of controlling pressure roll flare in a print apparatus including a fuser having a fuser surface, including at least one heat source coupled to the fuser, including a pressure roll having a pressure roll surface, the pressure roll having a rotational axis, the pressure roll having an inside paper path portion towards the middle of the pressure roll along the rotational axis and having an outside paper path portion near at least one end of the pressure roll along the rotational axis, the pressure roll coupled to the fuser at a fuser nip, and the print apparatus including a pressure roll cooling device. The method can include heating the fuser surface using the at least one heat source. The method can include fusing marking material on a media sheet in the fuser nip. The method can include cooling at least one of the inside paper path portions and the outside paper path portions of the pressure roll using the pressure roll cooling device to maintain substantially consistent pressure roll flare prior to media sheets entering the fuser nip and while media sheets pass through the fuser nip to provide wrinkle control of media sheets while limiting image smear of the marking material on the media sheets.

The embodiments further include an apparatus that controls pressure roll flare in a print apparatus. The apparatus can include a fuser heater roll. The apparatus can include at least one heat source coupled to the fuser heater roll. The heat source can be configured to heat the fuser heater roll. The apparatus can include a fuser belt having a fuser belt surface, where the fuser belt can be wrapped around a portion of the fuser heater roll. The apparatus can include a pressure roll having a pressure roll surface. The pressure roll can have a rotational axis. The pressure roll can have an inside paper path portion towards the middle of the pressure roll along the rotational axis and can have an outside paper path portion near at least one end of the pressure roll along the rotational axis. The pressure roll can be coupled to the fuser heater roll via the fuser belt at a fuser nip. The fuser nip can be configured to fuse marking material on a media sheet. The apparatus can include a pressure roll cooling device coupled to the pressure roll. The pressure roll cooling device can be configured to selectively cool the inside paper path portion and/or the outside paper path portion of the pressure roll to maintain pressure roll flare and provide wrinkle control of the media sheets while the media sheets pass through the fuser nip and to avoid excessive pressure roll flare and limit image smear of the marking material on the media sheets while the media sheets pass through the fuser nip. Pressure roll flare can be a larger radius of the pressure roll near the pressure roll outside paper path portion than a radius of the pressure roll near the pressure roll inside paper path portion.

Figure 2:
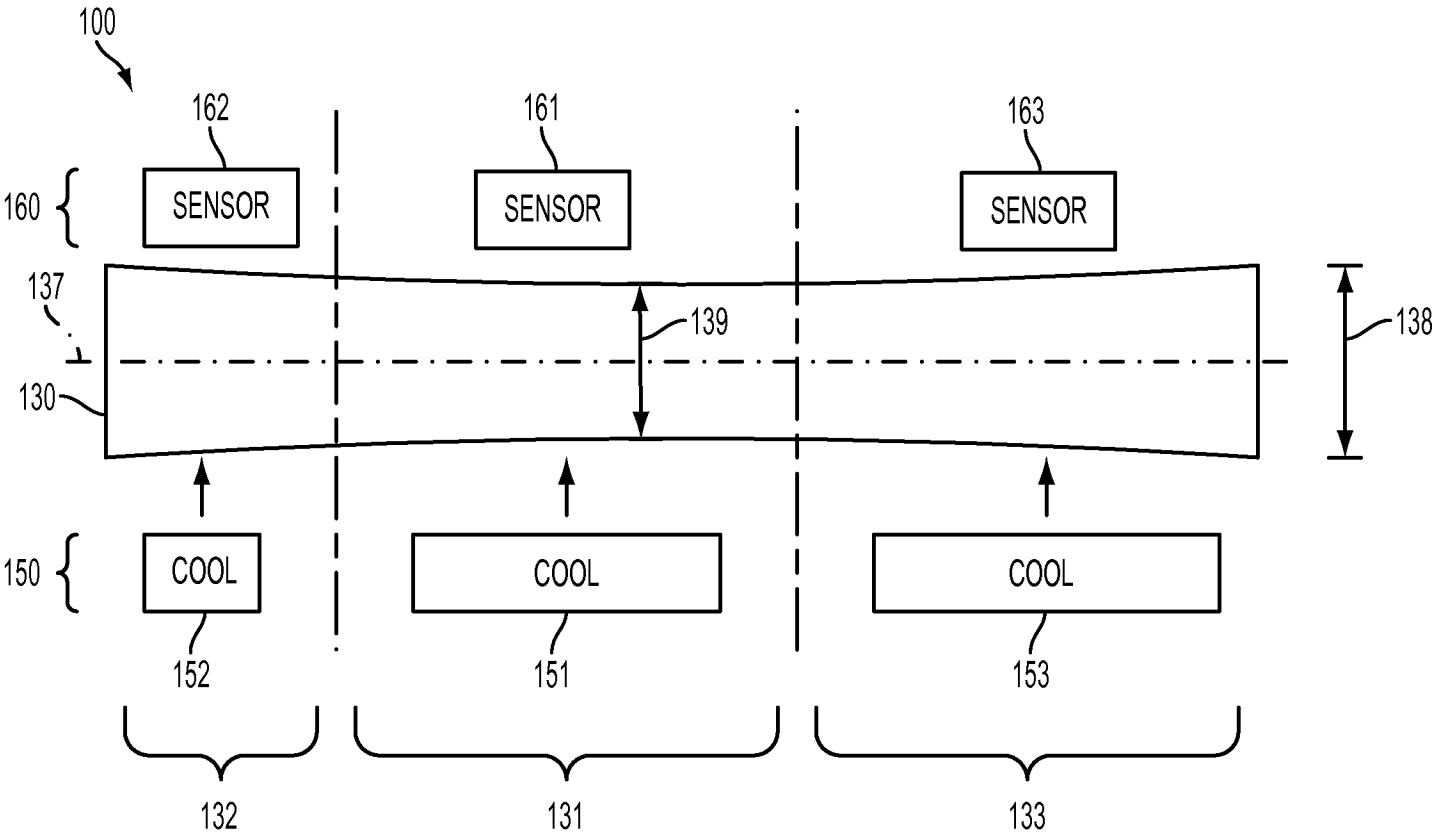
FIG. 2 is an example illustration of an apparatus with a view orthogonal to the view of FIG. 1.

FIG. 1 and FIG. 2 are exemplary illustrations of an apparatus 100, such as an electrostatographic printing apparatus, a xerographic printing apparatus, an ink-jet printing apparatus, or any other apparatus that generates an image on media. The apparatus 100 may also be part of a printer, a multifunction media device, a xerographic machine, a laser printer, or any other device that generates an image on media. The apparatus 100 can include a fuser 110 having a fuser surface 112. The fuser 110 can include a fuser belt 114, can be a fuser roll, can be a fuser drum, or can be any other heated fuser member.

The apparatus 100 can include at least one heat source 120 configured to heat the fuser surface 112. The apparatus 100 can include a pressure roll 130 having a pressure roll surface 135. The pressure roll 130 can have a rotational axis 137. The pressure roll 130 can have an inside paper path portion 131 towards the middle of the pressure roll 130 along the rotational axis 137 and can have an outside paper path portion 132 and/or 133 near at least one end of the pressure roll 130 along the rotational axis 137. Embodiments will be described with respect to the outside paper path portion 132, but such descriptions will cover one of or both of outside paper path portion 132 and/or outside paper path portion 133. The pressure roll 130 can be coupled to the fuser 110 at a fuser nip 140. The fuser nip 140 can be configured to fuse marking material on a media sheet 145.

The apparatus 100 can include a pressure roll cooling device 150 configured to cool at least one of the inside paper path portion 131 and the outside paper path portion 132 of the pressure roll 130 to maintain substantially consistent pressure roll flare prior to media sheets entering the fuser nip 140 and while media sheets pass through the fuser nip 140 to provide wrinkle control of media sheets while limiting image smear of the marking material on the media sheets. Pressure roll flare can be defined as a larger diameter 138 of the pressure roll 130 near the pressure roll outside paper path portion 132 than a diameter 139 of the pressure roll 130 near the pressure roll inside paper path portion 131.

The pressure roll cooling device 150 can include a pressure roll inside paper path cooling device 151 and at least one pressure roll outside paper path cooling device 152 and/or 153. For example, the pressure roll inside paper path cooling device 151 can cool the pressure roll inside paper path portion 131 prior to a print job to keep a pressure roll standby flare prior to the print job close to a pressure roll steady state flare during the print job by controlling pressure roll thermal expansion. As another example, the at least one pressure roll outside paper path cooling device 152 and/or 153 can cool the pressure roll outside paper path portion 132 and/or 133 to keep a pressure roll steady state flare during a print job close to a pressure roll standby flare prior to a print job by controlling pressure roll thermal expansion. As a further example, the pressure roll inside paper path cooling device 151 and the at least one pressure roll outside paper path cooling device 152 and/or 153 can cool the pressure roll 130 to keep a pressure roll standby flare prior to a print job close to a pressure roll steady state flare during a print job by controlling pressure roll thermal expansion. The pressure roll cooling device 150 can selectively cool at least one of the inside paper path portion 131 and the outside paper path portion 132 of the pressure roll 130. For example, the pressure roll cooling device 150 can turn on and off the pressure roll inside paper path cooling device 151 and/or the at least one pressure roll outside paper path cooling device 152 and/or 153 depending on a desired temperature of the pressure roll 130 at different locations along the pressure roll rotational axis 137.

The pressure roll inside paper path cooling device 151 can cool the pressure roll inside paper path portion 131 to control standby flare prior to a print job. The at least one pressure roll outside paper path cooling device 152 and/or 153 can cool the pressure roll outside paper path portion 132 and/or 133 to control steady state flare during a print job. The pressure roll inside paper path cooling device 151 and the pressure roll outside paper path cooling device 152 and/or 153 can also both cool the pressure roll 130 during a print job or prior to a print job to achieve a desired pressure roll flare.

The apparatus 100 can include a pressure roll temperature sensor 160. The pressure roll temperature sensor 160 can include pressure roll inside paper path temperature sensor 161 that can sense an inside paper path temperature of the pressure roll inside paper path 131. The pressure roll temperature sensor 160 can include a pressure roll outside paper path temperature sensor 162 and/or 163 that can sense an outside paper path temperature of the pressure roll outside paper path 132 and/or 133. The apparatus 100 can include a controller 170 coupled to the pressure roll inside paper path temperature sensor 161 and coupled to the pressure roll outside paper path temperature sensor 162 and/or 163. The controller 170 can control the pressure roll cooling device 150 based on the sensed inside paper path temperature and the sensed outside paper path temperature to control pressure roll flare to provide wrinkle control of the media sheet 145 while limiting image smear of the marking material on the media sheet 145. The controller 170 can maintain a desired difference between the temperature of the pressure roll inside paper path 131 and the temperature of the pressure roll outside paper path 132 and/or 133. The temperature difference can depend on the starting flare of the pressure roll 130. For example, if the pressure roll 130 already has desired flare during standby, the pressure roll cooling device 150 can cool the outside paper path portion 132 and/or 133 during a print job and may not need to cool the inside paper path portion 131 during standby. As an example of an experiment, 30 deg C. can increase the flare 0.2-0.25 mm for a given thickness of silicon rubber. The actual temperatures used can depend on the materials used for the pressure roll 130. Different materials can have different thermal conductivity, different thermal expansion coefficient, and other different properties. The actual temperatures used can also depend on thickness, layers, hardness, and other properties of the material used for the pressure roll 130. As a further example, the flare range can be a function of hardness and thickness of layers of the pressure roll 130. The range can go up when rubber is softer and thicker and can go down when rubber is harder and thinner.

The pressure roll cooling device 150 can selectively cool at least the inside paper path portion 131 of the pressure roll to induce flare of the pressure roll 130 prior to the media sheet 145 entering the fuser nip 140 to give the pressure roll 130 a flare difference in diameter of substantially 0.3 mm through 0.9 mm, where the flare difference in diameter is the difference between the diameter of the inside paper path portion 131 and the diameter of the outside paper path portion 132. For example, the pressure roll cooling device 150 can selectively cool at least one of the inside paper path portion 131 and the outside paper path portion 132 of the pressure roll 130 to maintain substantially consistent pressure roll flare prior to media sheets entering the fuser nip 140 and while media sheets pass through the fuser nip 140 to provide wrinkle control of media sheets while limiting image smear of the marking material on the media sheets. The pressure roll cooling device 150 can selectively cool at least the outside paper path portion 132 and/or 133 of the pressure roll 130 to maintain flare of the pressure roll 130 throughout a print job to give the pressure roll 130 a flare difference in diameter of substantially 0.3 mm through 0.9 mm, where the flare difference in diameter is the difference between the diameter of the inside paper path portion 131 and the diameter of the outside paper path portion 132 and/or 133 throughout the print job. The pressure roll cooling device 150 can selectively cool the inside paper path portion 131 of the pressure roll 130 to maintain flare of the pressure roll prior to the print job to give the pressure roll a flare difference in diameter of substantially 0.3 mm through 0.9 mm. As an example, the pressure roll cooling device 150 can provide a heat transfer coefficient of substantially 40 $W/m^2K$. Other heat transfer coefficients can be implemented depending on the desired amount of cooling.

To elaborate on one possible embodiment, a thermal differential between the pressure roll inside paper path 131 and the pressure roll outside paper path 132 can be caused by media sheets cooling the pressure roll inside paper path 131 during a print job. The pressure roll cooling device 150 can control pressure roll flare from different thermal differentials between standby operation and steady state print job operation, as well as from transitional thermal differentials between standby and steady state operation. For example, the pressure roll 130 can have a room temperature flare of 0.4 mm. Media sheets can cool the inside paper path 131 of the pressure roll 130 during a print job, which can reduce the diameter of the pressure roll inside paper path 131 and increase the pressure roll flare. During a print job, the pressure roll cooling device 150 can cool the pressure roll outside paper path to maintain, increase, or decrease the pressure roll flare depending on the amount of cooling.

The pressure roll cooling device 150 can also provide cooling to both the pressure roll inside paper path 131 and the pressure roll outside paper path 132. For example, a pressure roll 130 can start with less flare than desired. The pressure roll cooling device 150 can induce pressure roll flare during standby by cooling the inside paper path 131 prior to a print job. This can help reduce the transient, such as the change, between standby flare and steady state flare during a print job. For example, the pressure roll can start with 0.3 mm flare and the pressure roll cooling device inside paper path cooling can cause 0.5 mm of flare prior to a print job. When a media sheet contacts the pressure roll, the pressure roll cooling device 150 can stop inside paper path cooling and start outside paper path cooling to avoid extra flare.

The parameters of operation of the pressure roll cooling device 150 can be determined in an open loop or a closed loop manner. For example, for open loop control, the pressure roll cooling device parameters of operation can be based on tests, laboratory measurements, or other information obtained prior to pressure roll cooling device operation. For closed loop control, sensors can be used along with the pressure roll cooling device 150 to maintain the pressure roll inside paper path temperature and the pressure roll outside paper path temperature within a desired range. There may be different requirements for standby and run temperatures. The pressure roll inside paper path 131 can be cooled during standby, the pressure roll outside paper path 132 can be cooled during a print job, both paper paths can be cooled appropriately during standby and during a print job, and other combinations are possible. For example, either only the inside or only the outside paper path can be cooled to minimize space, cost, or other requirements of the pressure roll cooling device 150.

Figure 3:
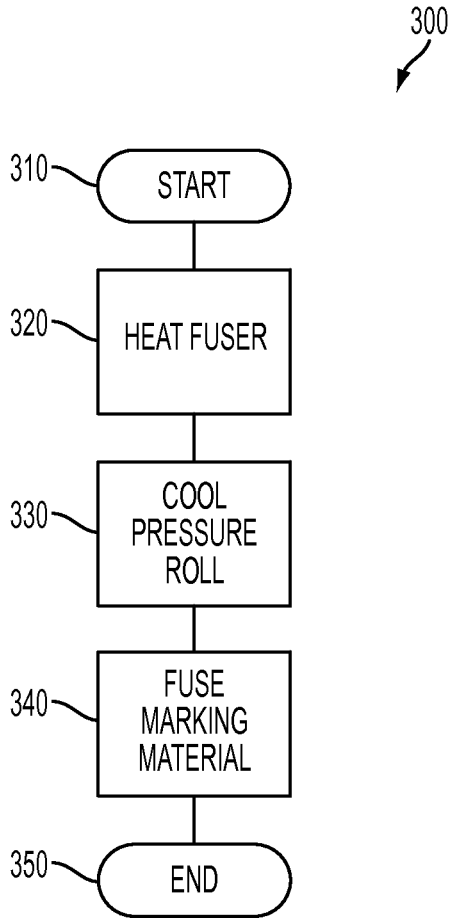
FIG. 3 illustrates an example flowchart of a method in a printing apparatus.

FIG. 3 illustrates an exemplary flowchart 300 of a method in a printing apparatus, such as the apparatus 100, including a fuser having a fuser surface, at least one heat source coupled to the fuser, a pressure roll having a pressure roll surface, the pressure roll having a rotational axis, the pressure roll having an inside paper path portion towards the middle of the pressure roll along the rotational axis and having an outside paper path portion near at least one end of the pressure roll along the rotational axis, the pressure roll coupled to the fuser at a fuser nip, and the apparatus including a pressure roll cooling device. The pressure roll flare can be defined as a larger radius of the pressure roll near the pressure roll outside paper path portion than a radius of the pressure roll near the pressure roll inside paper path portion. The pressure roll cooling device can include a pressure roll inside paper path cooling device and/or at least one pressure roll outside paper path cooling device.

The method can start at 310. At 320, the fuser surface can be heated using the at least one heat source. At 330, the inside paper path portion and/or the outside paper path portion of the pressure roll can be cooled using the pressure roll cooling device to maintain substantially consistent pressure roll flare prior to media sheets entering the fuser nip and while media sheets pass through the fuser nip to provide wrinkle control of media sheets while limiting image smear of the marking material on the media sheets. Cooling can include cooling the pressure roll inside paper path portion prior to a print job to keep a pressure roll standby flare prior to the print job close to a pressure roll steady state flare during the print job by controlling pressure roll thermal expansion. Cooling can also include cooling the pressure roll outside paper path portion to keep a pressure roll steady state flare during a print job close to a pressure roll standby flare prior to a print job by controlling pressure roll thermal expansion. Cooling can further include cooling the pressure roll inside paper path with the pressure roll inside paper path cooling device and cooling the pressure roll outside paper path with the at least one pressure roll outside paper path cooling device to keep a pressure roll standby flare prior to a print job close to a pressure roll steady state flare during a print job by controlling pressure roll thermal expansion. Cooling can additionally include cooling the pressure roll inside paper path with the pressure roll inside paper path cooling device to control standby flare prior to a print job and cooling the pressure roll outside paper path with the at least one pressure roll outside paper path cooling device to control steady state flare during a print job. Cooling can also include cooling at least one of the inside paper path portion and the outside paper path portion of the pressure roll to maintain substantially consistent flare of the pressure roll prior to a print job and during a print job to give the pressure roll a flare difference in diameter of substantially 0.3 mm through 0.9 mm, where the flare difference in diameter is the difference between the diameter of the inside paper path portion and the diameter of the outside paper path portion.

At 340, marking material can be fused on a media sheet in the fuser nip. At 350, the method can end. According to some embodiments, all of the blocks of the flowchart 300 are not necessary. Additionally, the flowchart 300 or blocks of the flowchart 300 may be performed numerous times, such as iteratively. For example, the flowchart 300 may loop back from later blocks to earlier blocks. Furthermore, many of the blocks can be performed concurrently or in parallel processes.

Figure 4:
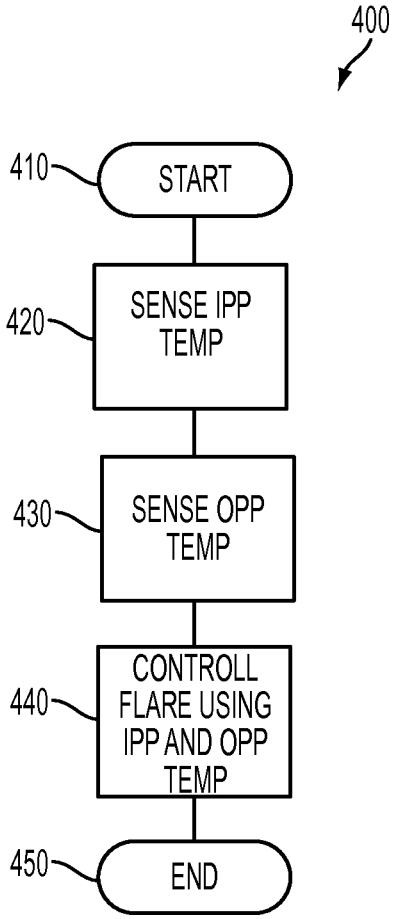
FIG. 4 illustrates an example flowchart of a method in a printing apparatus.

FIG. 4 illustrates an exemplary flowchart 400 of a method in a printing apparatus, such as the apparatus 100. The blocks of the flowchart 400 can be incorporated into the flowchart 300. The printing apparatus can include a pressure roll inside paper path temperature sensor and a pressure roll outside paper path temperature sensor.

The method can start at 410. At 420, an inside paper path temperature of the pressure roll inside paper path can be sensed using the pressure roll inside paper path temperature sensor. At 430, an outside paper path temperature of the pressure roll outside paper path can be sensed using the pressure roll outside paper path temperature sensor. At 440, the pressure roll cooling device can be operated to control pressure roll flare based on the sensed inside paper path temperature and based on the sensed outside paper path temperature to provide wrinkle control of the media sheet while limiting image smear of the marking material on the media sheet. At 450, the method can end.

According to some embodiments, all of the blocks of the flowchart 400 are not necessary. Additionally, the flowchart 400 or blocks of the flowchart 400 may be performed numerous times, such as iteratively. For example, the flowchart 400 may loop back from later blocks to earlier blocks. Furthermore, many of the blocks can be performed concurrently or in parallel processes.

Figure 5:
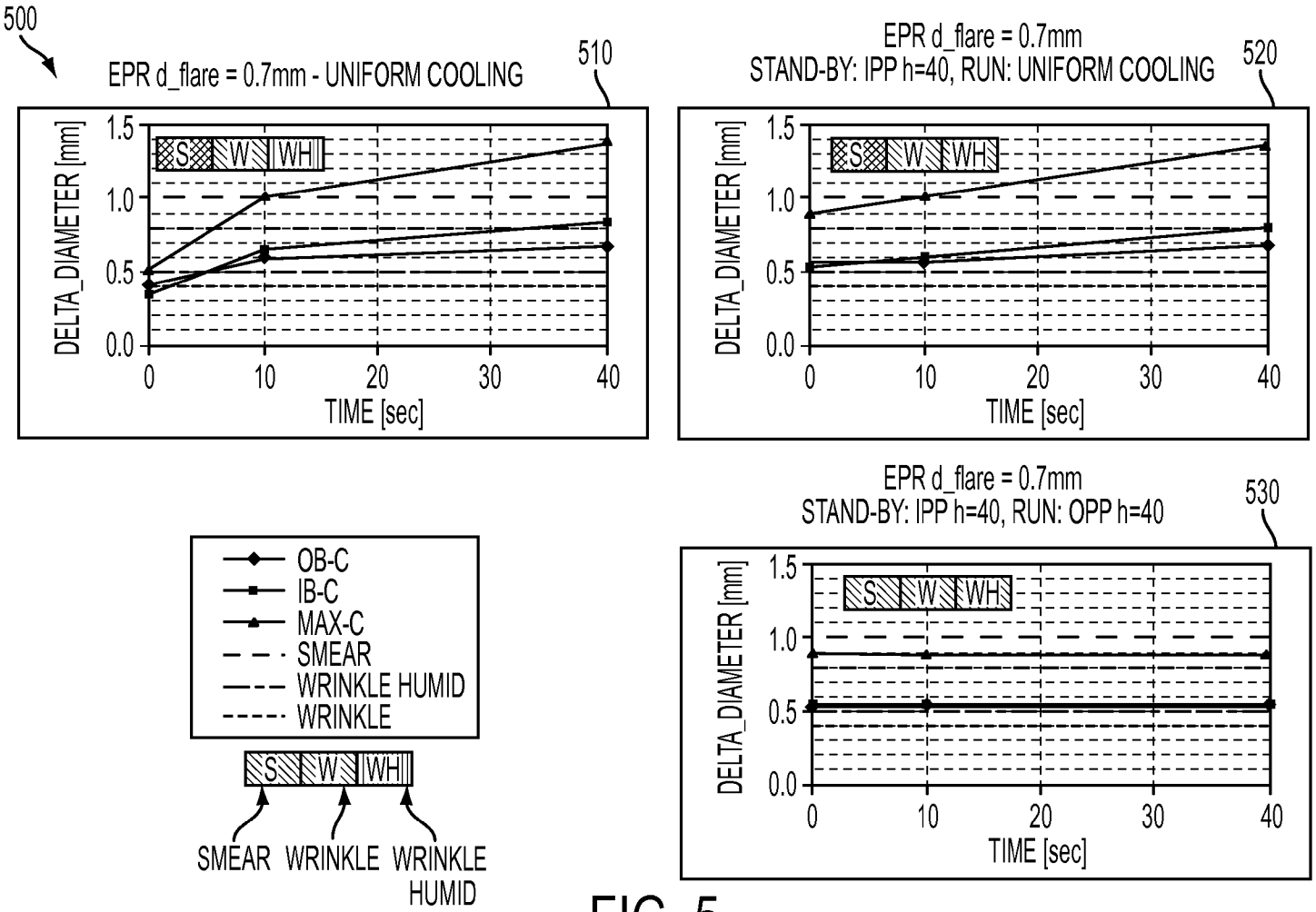
FIG. 5 is an example illustration of graphs illustrating flare transient control.

FIG. 5 is an exemplary illustration 500 of graphs 510, 520, and 530 illustrating flare transient control with a pressure roll flare of 0.7 mm with different cooling strategies. Graph 510 illustrates a change in diameter of the pressure roll flare with uniform cooling. Graph 520 illustrates the change in diameter of the pressure roll flare with stand by inside paper path cooling with a heat transfer coefficient of 40 $W/m^2K$. Graph 530 illustrates change in diameter of the pressure roll flare with inside paper path cooling with a heat transfer coefficient of 40 $W/m^2K$ during stand-by and outside paper path cooling with a heat transfer coefficient of 40 $W/m^2K$ during a print job. The graphs illustrate how wrinkle control can be enough for non-humid and humid media with stand-by cooling of the inside paper path. However, smear may result unless outside paper path cooling is provided during the print job run.

Figure 6B:
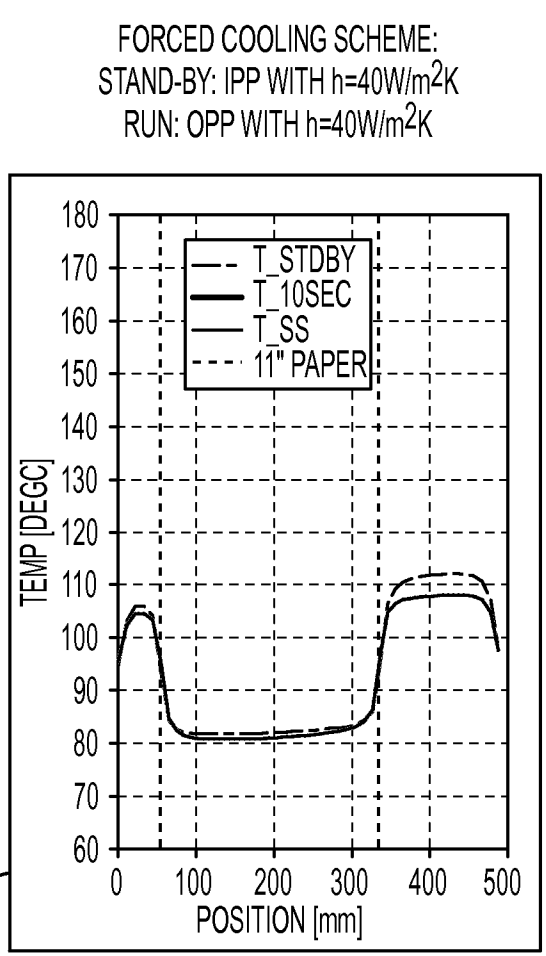
FIGS. 6A and 6B are example illustrations of graphs illustrating pressure roll temperature distribution.
Figure 6A:
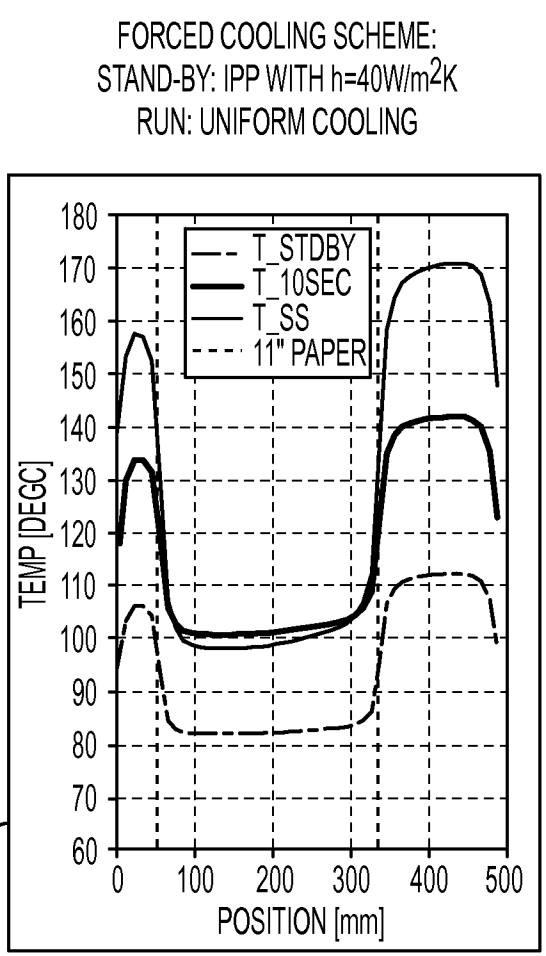

FIGS. 6A and 6B are example illustrations 600 of graphs 610 and 620 illustrating pressure roll temperature distribution with different cooling methods when the inside paper path has 11" wide media. Graph 610 illustrates a forced cooling scheme with inside paper path cooling during stand-by with a heat transfer coefficient of h=40 $W/m^2K$ and uniform cooling during a print job run. Graph 620 illustrates a forced cooling scheme with inside paper path cooling during stand-by with a heat transfer coefficient of h=40 $W/m^2K$ and outside paper path cooling during a print job run with a heat transfer coefficient of h=40 $W/m^2K$. The graphs illustrate how modeling predicts that with stand-by inside paper path cooling with an h=40 $W/m^2K$ a pressure roll temperature differential of 25-30° C. can be achieved. Also, with outside paper path cooling during run with an h=40 $W/m^2K$, the overheating of the pressure roll outside paper path can be reduced from 170° C. to 110° C.

Figure 7A:
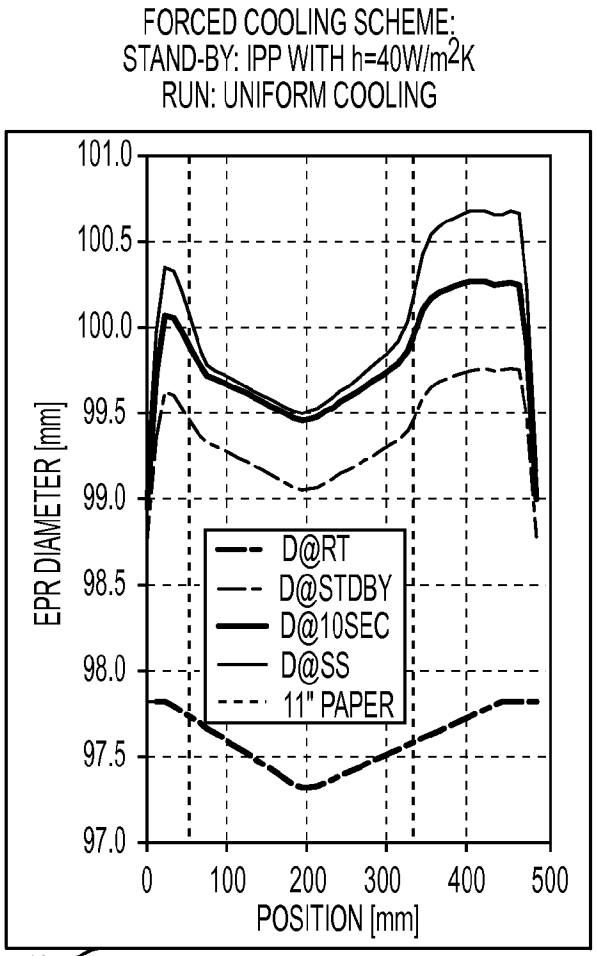
FIGS. 7A and 7B are example illustrations of graphs illustrating pressure roll flare change.
Figure 7B:
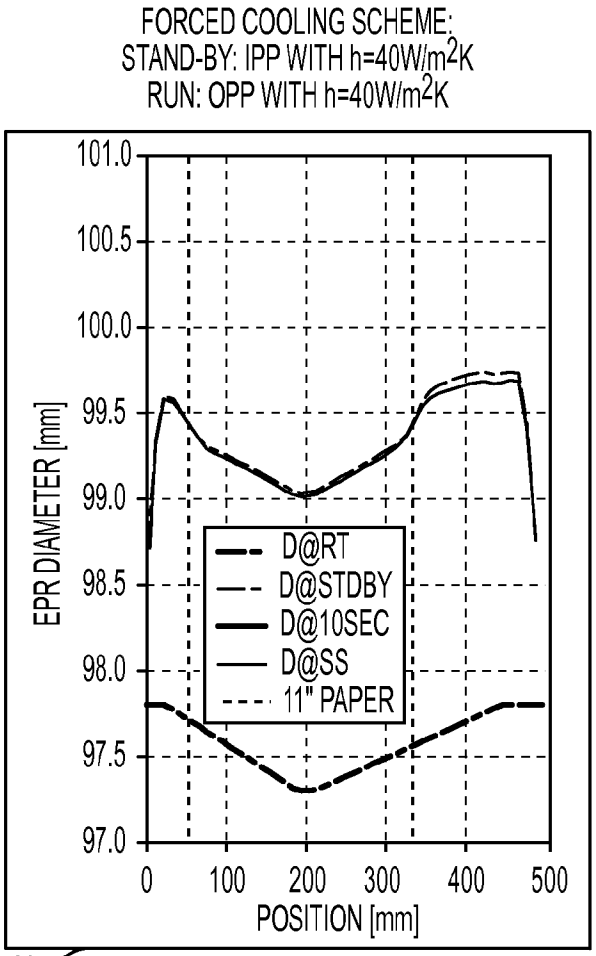

FIGS. 7A and 7B are example illustrations 700 of graphs 710 and 720 illustrating pressure roll flare change within a print job run with different cooling methods when 11" wide media is run through the inside paper path and the initial flare is 0.5 mm. Graph 710 illustrates a forced cooling scheme with inside paper path cooling during stand-by with a heat transfer coefficient of h=40 $W/m^2K$ and uniform cooling during a print job run. Graph 720 illustrates a forced cooling scheme with inside paper path cooling during stand-by with a heat transfer coefficient of h=40 $W/m^2K$ and outside paper path cooling during a print job run with a heat transfer coefficient of h=40 $W/m^2K$. The graphs illustrate how modeling predicts that with stand-by inside paper path cooling with an h=40 $W/m^2K$ the 11" inside paper path flare can be closer to the steady state flare. This combined with outside paper path cooling during a print job run with an h=40 $W/m^2K$ can maintain the stand-by and steady state print job flare close by controlling the pressure roll thermal expansion.

Figure 8:
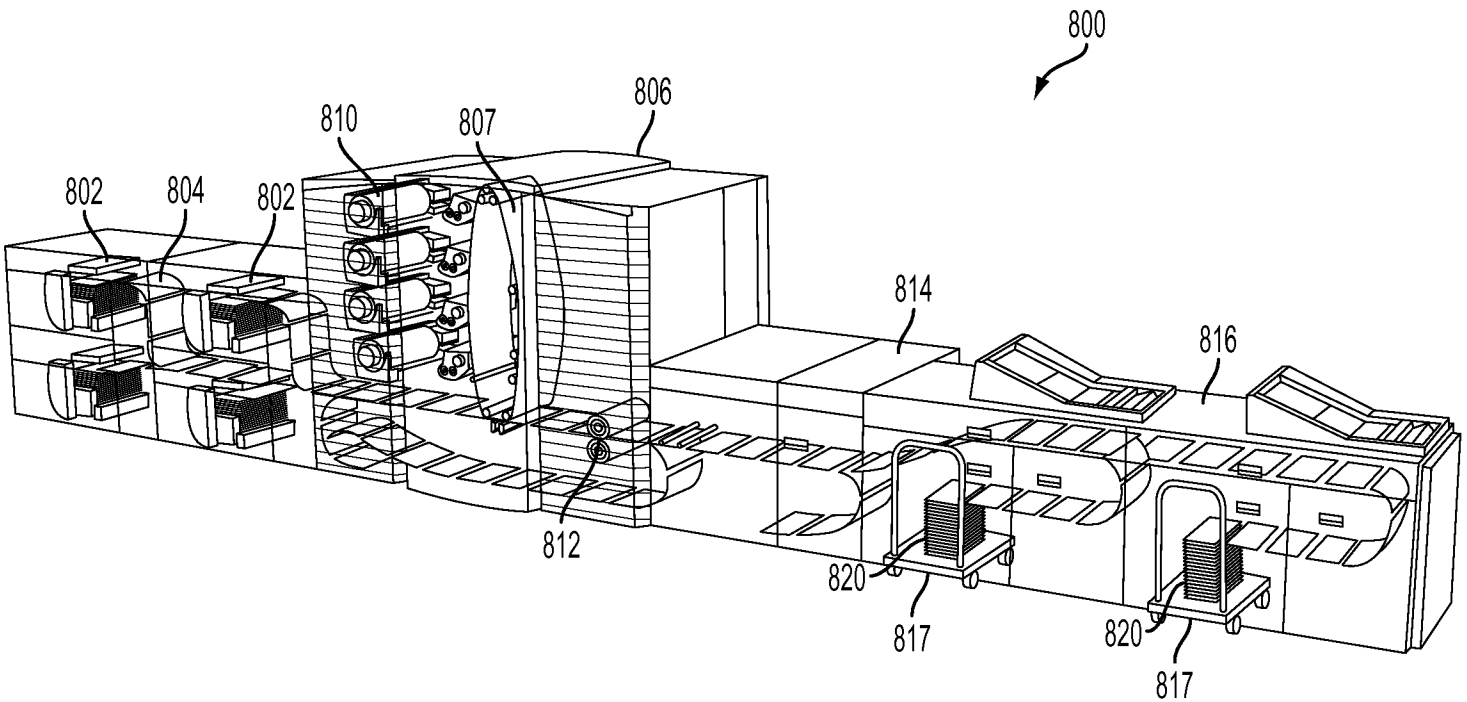
FIG. 8 illustrates an example printing apparatus.

FIG. 8 illustrates an exemplary printing apparatus 800, such as the apparatus 100. As used herein, the term "printing apparatus" encompasses any apparatus, such as a digital copier, bookmaking machine, multifunction machine, and other printing devices that perform a print outputting function for any purpose. The printing apparatus 800 can be used to produce prints from various media, such as coated, uncoated, previously marked, or plain paper sheets. The media can have various sizes and weights. In some embodiments, the printing apparatus 800 can have a modular construction. As shown, the printing apparatus 800 can include at least one media feeder module 802, a printer module 806 adjacent the media feeder module 802, an inverter module 814 adjacent the printer module 806, and at least one stacker module 816 adjacent the inverter module 814.

In the printing apparatus 800, the media feeder module 802 can be adapted to feed media 804 having various sizes, widths, lengths, and weights to the printer module 806. In the printer module 806, toner is transferred from an arrangement of developer stations 810 to a charged photoreceptor belt 807 to form toner images on the photoreceptor belt 807. The toner images are transferred to the media 804 fed through a paper path. The media 804 are advanced through a fuser 812 adapted to fuse the toner images on the media 804. The inverter module 814 manipulates the media 804 exiting the printer module 806 by either passing the media 804 through to the stacker module 816, or by inverting and returning the media 804 to the printer module 806. In the stacker module 816, printed media are loaded onto stacker carts 817 to form stacks 820.

Some embodiments can provide for cooling the pressure roll near the center of the inside paper path during stand-by and to induce additional pressure roll flare at the beginning of the run. This can reduce the requirement of additional initial flare of the pressure roll. By reducing the amount of flare on the pressure roll, the wrinkle control can be limited to avoid potential image smear due to excessive wrinkle control caused by the pressure roll differential thermal expansion within the run. Furthermore, a fuser belt can limit the ability to flare a fusing roll surface since it can cause the belt itself to wrinkle. Thus, embodiments can cool the pressure roll when using a fusing belt to provide and/or maintain pressure roll flare.

Although some of the embodiments of the above description are directed toward a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing. As used herein, any such marking material-to-media affixation processing shall be considered "fusing," regardless of its exact nature.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

I claim:

1. An apparatus useful in printing, the apparatus comprising:

a fuser having a fuser surface;

at least one heat source configured to heat the fuser surface;

a pressure roll having a pressure roll surface, a rotational axis, an inside paper path portion having an inside paper path diameter towards the middle of the pressure roll along the rotational axis and an outside paper path portion having an outside paper path diameter near at least one end of the pressure roll along the rotational axis, the pressure roll coupled to the fuser at a fuser nip, where-the fuser nip is configured to fuse marking material on a media sheet; and a pressure roll cooling device configured to cool at least one of the inside paper path portion and the outside paper path portion to selectively cause a pressure roll flare having a flare difference of substantially 0.3 mm to 0.9 mm, the flare difference being a difference between the inside paper path diameter and the outside paper path diameter of the pressure roll, wherein the flare difference is configured to provide wrinkle control of media sheets while limiting image smear of the marking material on the media sheets.

2. The apparatus according to claim 1, wherein the pressure roll flare is caused so that the outside paper path diameter is larger than the inside paper path diameter.

3. The apparatus according to claim 1, wherein the pressure roll cooling device comprises a pressure roll inside paper path cooling device, and the pressure roll inside paper path cooling device cools the pressure roll inside paper path portion prior to a print job to keep a pressure roll standby flare prior to the print job close to a pressure roll steady state flare during the print job by controlling pressure roll thermal expansion.

4. The apparatus according to claim 1, wherein the pressure roll cooling device comprises at least one pressure roll outside paper path cooling device, and the at least one pressure roll outside paper path cooling device cools the pressure roll outside paper path portion to keep a pressure roll steady state flare during a print job close to a pressure roll standby flare prior to a print job by controlling pressure roll thermal expansion.

5. The apparatus according to claim 1, wherein the pressure roll cooling device comprises a pressure roll inside paper path cooling device and at least one pressure roll outside paper path cooling device, and the pressure roll inside paper path cooling device and the at least one pressure roll outside paper path cooling device cool the pressure roll to keep a pressure roll standby flare prior to a print job close to a pressure roll steady state flare during a print job by controlling pressure roll thermal expansion.

6. The apparatus according to claim 5, wherein the pressure roll inside paper path cooling device cools the pressure roll inside paper path portion to control standby flare prior to a print job, and the at least one pressure roll outside paper path cooling device cools the pressure roll outside paper path portion to control steady state flare during a print job.

7. The apparatus according to claim 1, further comprising:

a pressure roll inside paper path temperature sensor configured to sense an inside paper path temperature of the pressure roll inside paper path;

a pressure roll outside paper path temperature sensor configured to sense an outside paper path temperature of the pressure roll outside paper path; and a controller coupled to the pressure roll inside paper path temperature sensor and coupled to the pressure roll outside paper path temperature sensor, the controller configured to control the pressure roll cooling device based on the sensed inside paper path temperature and the sensed outside paper path temperature to control pressure roll flare.

8. The apparatus according to claim 1, wherein the pressure roll cooling device selectively cools at least the inside paper path portion of the pressure roll to induce pressure roll flare prior to a media sheet entering the fuser nip.

9. The apparatus according to claim 1, wherein the pressure roll cooling device selectively cools at least the outside paper path portion of the pressure roll to maintain pressure roll flare during a print job.

10. The apparatus according to claim 9, wherein the pressure roll cooling device additionally selectively cools the inside paper path portion during the print job.

11. A method in a printing apparatus including a fuser having a fuser surface, at least one heat source coupled to the fuser, a pressure roll having a pressure roll surface, a rotational axis, an inside paper path portion having an inside paper path diameter towards the middle of the pressure roll along the rotational axis and an outside paper path portion having an outside paper path diameter near at least one end of the pressure roll along the rotational axis, the pressure roll coupled to the fuser at a fuser nip, and a pressure roll cooling device, the method comprising:

heating the fuser surface using the at least one heat source;

fusing marking material on a media sheet in the fuser nip; and cooling at least one of the inside paper path portion and the outside paper path portion of the pressure roll using the pressure roll cooling device to selectively cause a pressure roll flare having a flare difference of substantially 0.3 mm to 0.9 mm, the flare difference being a difference between the inside paper path diameter and the outside paper path diameter of the pressure roll, wherein the flare difference is configured to provide wrinkle control of media sheets while limiting image smear of the marking material on the media sheets.

12. The method according to claim 11, wherein the pressure roll flare is caused so that the outside paper path diameter is larger than the inside paper path diameter.

13. The method according to claim 11, wherein the pressure roll cooling device comprises a pressure roll inside paper path cooling device, and the cooling comprises cooling the pressure roll inside paper path portion prior to a print job to keep a pressure roll standby flare prior to the print job close to a pressure roll steady state flare during the print job by controlling pressure roll thermal expansion.

14. The method according to claim 11, wherein the pressure roll cooling device comprises at least one pressure roll outside paper path cooling device, and the cooling comprises cooling the pressure roll outside paper path portion to keep a pressure roll steady state flare during a print job close to a pressure roll standby flare prior to a print job by controlling pressure roll thermal expansion.

15. The method according to claim 11, wherein the pressure roll cooling device comprises a pressure roll inside paper path cooling device and at least one pressure roll outside paper path cooling device, and the cooling comprises cooling the pressure roll inside paper path with the pressure roll inside paper path cooling device and cooling the pressure roll outside paper path with the at least one pressure roll outside paper path cooling device to keep a pressure roll standby flare prior to a print job close to a pressure roll steady state flare during a print job by controlling pressure roll thermal expansion.

16. The method according to claim 15, wherein the cooling comprises cooling the pressure roll inside paper path with the pressure roll inside paper path cooling device to control standby flare prior to a print job and cooling the pressure roll outside paper path with the at least one pressure roll outside paper path cooling device to control steady state flare during a print job.

17. The method according to claim 11, wherein the printing apparatus comprises a pressure roll inside paper path temperature sensor and a pressure roll outside paper path temperature sensor, and the method further comprises:

sensing an inside paper path temperature of the pressure roll inside paper path using the pressure roll inside paper path temperature sensor;

sensing an outside paper path temperature of the pressure roll outside paper path using the pressure roll outside paper path temperature sensor; and causing the pressure roll cooling device to control pressure roll flare based on the sensed inside paper path temperature and the sensed outside paper path temperature.

18. The method according to claim 11, wherein the cooling comprises cooling at least one of the inside paper path portion and the outside paper path portion of the pressure roll to maintain substantially consistent pressure roll flare prior to a print job and during a print job.

19. An apparatus useful in printing, the apparatus comprising:

a fuser heater roll;

at least one heat source coupled to the fuser heater roll, the heat source configured to heat the fuser heater roll;

a fuser belt having a fuser belt surface, the fuser belt wrapped around a portion of the fuser heater roll;

a pressure roll having a pressure roll surface, a rotational axis, an inside paper path portion having an inside paper path diameter towards the middle of the pressure roll along the rotational axis and an outside paper path portion having an outside paper path diameter near at least one end of the pressure roll along the rotational axis, the pressure roll being coupled to the fuser heater roll via the fuser belt at a fuser nip, where the fuser nip is configured to fuse marking material on a media sheet; and a pressure roll cooling device coupled to the pressure roll, the pressure roll cooling device configured to selectively cool at least one of the inside paper path portion and the outside paper path portion of the pressure roll to selectively cause a pressure roll flare having a flare difference of substantially 0.3 mm to 0.9 mm, the flare difference being a difference between the outside paper path diameter and the inside paper path diameter of the pressure roll, wherein the flare difference is configured to provide wrinkle control of media sheets while limiting image smear of the marking material on the media sheets and the pressure roll flare is caused so that the outside paper path diameter is larger than the inside paper path diameter.

20. The apparatus according to claim 19, further comprising:

a pressure roll inside paper path temperature sensor configured to sense a temperature of the pressure roll inside paper path;

a pressure roll outside paper path temperature sensor configured to sense a temperature of the pressure roll outside paper path; and a controller coupled to the pressure roll inside paper path temperature sensor and coupled to the pressure roll outside paper path temperature sensor, the controller configured to control the pressure roll cooling device to control pressure roll flare.

* * * * *